US006044609A

United States Patent [19]

Kim

[11] Patent Number: 6,044,609

[45] Date of Patent: Apr. 4, 2000

[54] STRUCTURE FOR ATTACHING FURRING PANELS ON BUILDING

[75] Inventor: Sun Shim Kim, Seoul, Rep. of Korea

[73] Assignee: Hyunsanmoeum Inc., Seoul, Rep. of Korea

[21] Appl. No.: 09/132,304

[22] Filed: Aug. 11, 1998

[30] Foreign Application Priority Data

Sep. 8, 1997 [KR] Rep. of Korea ..... 97-25440

[51] Int. Cl.[7] ..... E04D 1/34

[52] U.S. Cl. ..... 52/551; 52/519; 52/531; 52/540; 52/545; 52/546; 52/549; 52/478

[58] Field of Search ..... 52/519, 527, 529, 52/531, 540, 545, 546, 547, 549, 551, 553, 478

[56] References Cited

U.S. PATENT DOCUMENTS

| | | | |
|---|---|---|---|
| 2,766,861 | 10/1956 | Abramson . | |
| 3,903,670 | 9/1975 | Robinson, Jr. | 52/478 |
| 3,977,145 | 8/1976 | Dobby et al. | 52/531 |
| 4,047,349 | 9/1977 | Aguilar, Jr. | 52/551 |
| 4,435,938 | 3/1984 | Rutkowski et al. | 52/521 |
| 4,450,665 | 5/1984 | Katz | 52/522 |
| 4,580,383 | 4/1986 | Pittman et al. | 52/520 |
| 4,736,565 | 4/1988 | Bisson | 52/526 |
| 5,560,170 | 10/1996 | Ganser et al. | 52/539 |
| 5,878,543 | 3/1999 | Mowery | 52/519 |

*Primary Examiner*—Carl D. Friedman
*Assistant Examiner*—Yvonne M. Horton
*Attorney, Agent, or Firm*—Shlesinger, Arkwright & Garvey LLP

[57] ABSTRACT

A structure for attaching furring panels on a building is disclosed. The structure has longitudinal panel holders fixed to the building. A plurality of hooks are regularly mounted along each of the holders. The furring panels are held on the panel holders while passing across the holders, thus being attached on the building. The panels individually have a plurality of downward insert rails, thus being caught by the hooks of the holders. Each of the panels also has both a top channel and a downward lower rail, thus being coupled to another furring panel with the lower rail being fitted into the top channel of the other furring panel. The above structure allows the panels to be uniformly expandable or contractible in accordance with a change of atmospheric temperature, thus almost completely preventing the furring panels from partially warping or cracking.

6 Claims, 5 Drawing Sheets

STRUCTURE FOR ATTACHING FURRING PANELS ON BUILDING

BACKGROUND OF THE INVENTION

1. Field of the Invention

The present invention relates, in general, to a structure for attaching furring panels on the exterior wall of a building for the purpose of decorating the building and, more particularly, to a structure for movably attaching the furring panels on the exterior wall of a building such as a house while allowing the panels to be expandable or contractible in accordance with a change of atmospheric temperature.

2. Description of the Prior Art

As well known to those skilled in the art, typical furring panels for buildings are attached on a building's exterior wall as follows. That is, a first furring panel is primarily attached on a desired position of the building's exterior wall using a plurality of locking nails after horizontally arranging the panel on the building. Thereafter, a second furring panel is positioned above the first panel with the inside wall of the second panel's lower edge closely overlapping with the outside wall of the first panel's top edge. The second panel is, thereafter, attached to the exterior wall of the building using a plurality of locking nails. The above-mentioned process of attaching the furring panels on the building is repeated until a desired area of the exterior wall of the building is completely covered with such panels. In a brief description, the typical furring panels are fixedly attached on a building using nails, so that the panels are not allowed to be movable on the building.

However, such a typical process of attaching the furring panels on a building is accomplished by driving nails into the panels prior to fixing the panels to the building. The typical process thus wastes labor and may crack the panels at positions around the nail holes while driving nails into the panels to fix the panels to the building. Particularly, since the panels are fixedly attached on the building using nails, the panels may thermally expand or contract in accordance with a change of atmospheric temperature. In such a case, the panels may partially warp or crack at positions around their nail holes, thus being reduced in their rigidity and spoiling the appearance of the building.

SUMMARY OF THE INVENTION

Accordingly, the present invention has been made keeping in mind the above problems occurring in the prior art, and object of the present invention is to provide a structure for removably and easily attaching furring panels on a building such as a house while allowing the panels to be uniformly expandable or contractible in accordance with a change of atmospheric temperature, thus almost completely preventing any warping or cracking of panels due to a change of temperature.

In order to accomplish the above object, the present invention provides a structure for attaching furring panels on a building, comprising: a plurality of longitudinal panel holders vertically and parallel arranged on and fixed to an exterior wall of the building, with a plurality of hooks being regularly mounted along each of the holders; and a plurality of furring panels held on the panel holders while passing across the holders, thus being attached on the building, the panels individually having a plurality of downward insert rails, thus being caught by the hooks of the holders at the insert rails, each of the panels also having both a top channel formed along its top edge and a downward lower rail formed on an inside wall along its lower edge, thus being coupled to another furring panel with the lower rail being fitted into the top channel of the other furring panel.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
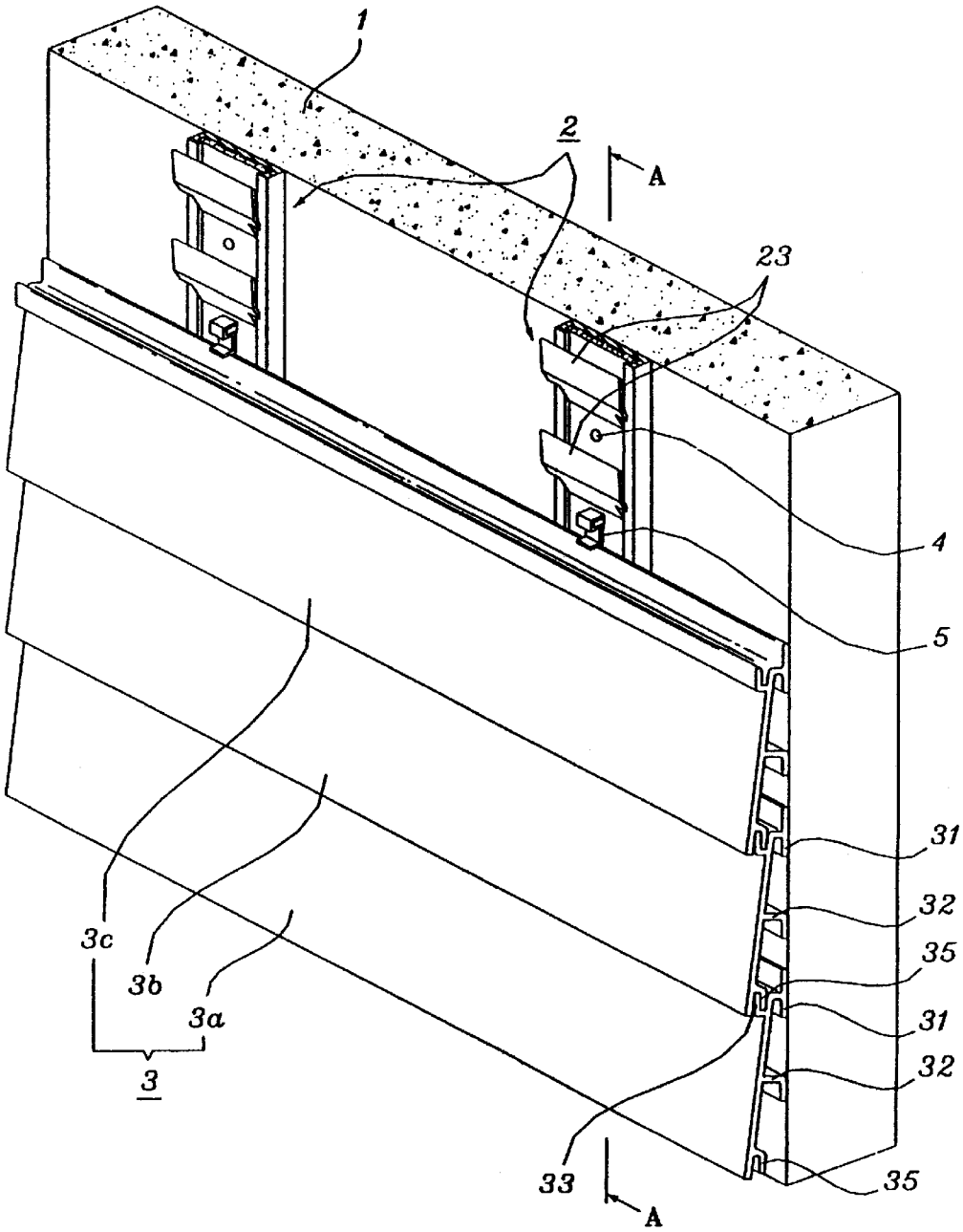
FIG. 1 is a perspective view showing furring panels attached on a building using a structure in accordance with the preferred embodiment of this invention.
Figure 2:
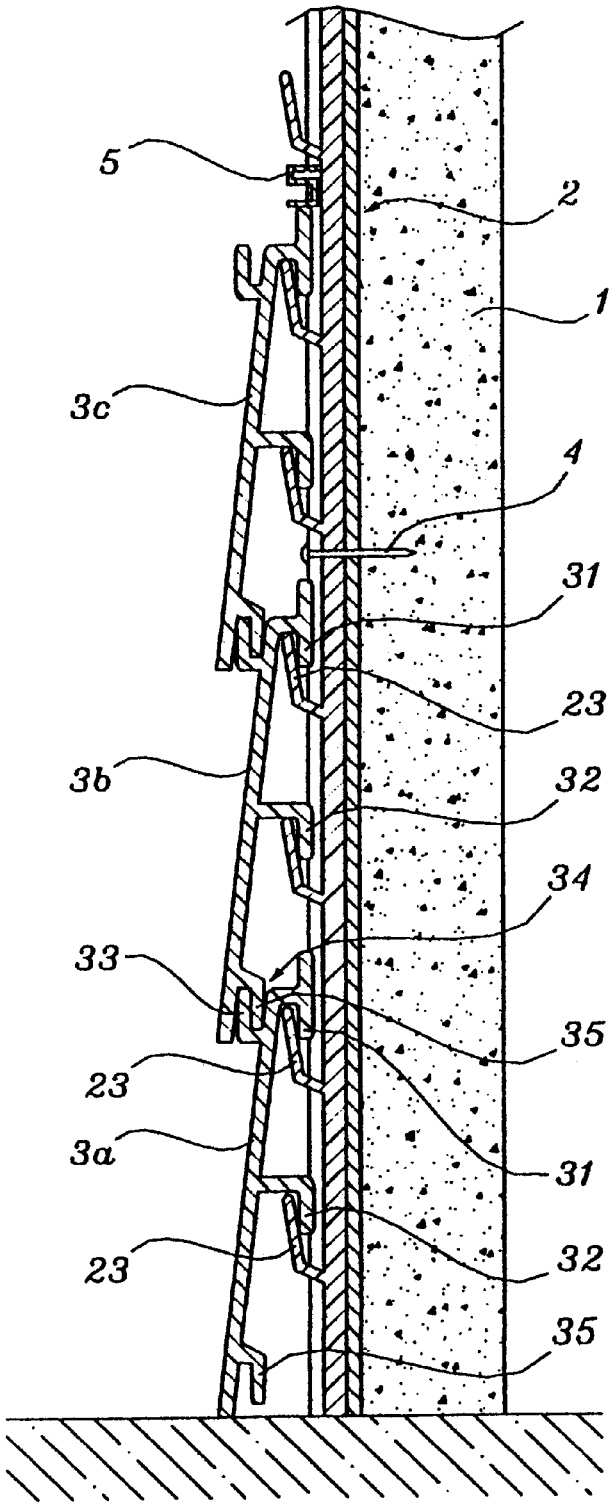
FIG. 2 is a sectional view taken along the line of A—A of FIG. 1.

FIGS. 1 and 2 show furring panels attached to the exterior wall of a building using the structure in accordance with the preferred embodiment of this invention. As shown in the drawings, the furring panel attaching structure of this invention comprises a plurality of panel holders 2 which are vertically and parallel arranged on and fixed to the exterior wall 1 or a cement wall of a building. A plurality of hooks 23 are regularly mounted along each panel holder 2, thus being regularly spaced apart from each other. In order to accomplish the structure of this invention, each of the furring panels 3 has a downward top insert rail 31 at its top edge. The top insert rail 31 is formed along the top edge of each panel 3 to be positioned on the inside wall of the panel 3. The above rail 31 is removably caught by the hooks 23 of the panel holder 2 when the panel 3 is attached on the building.

Figure 3:
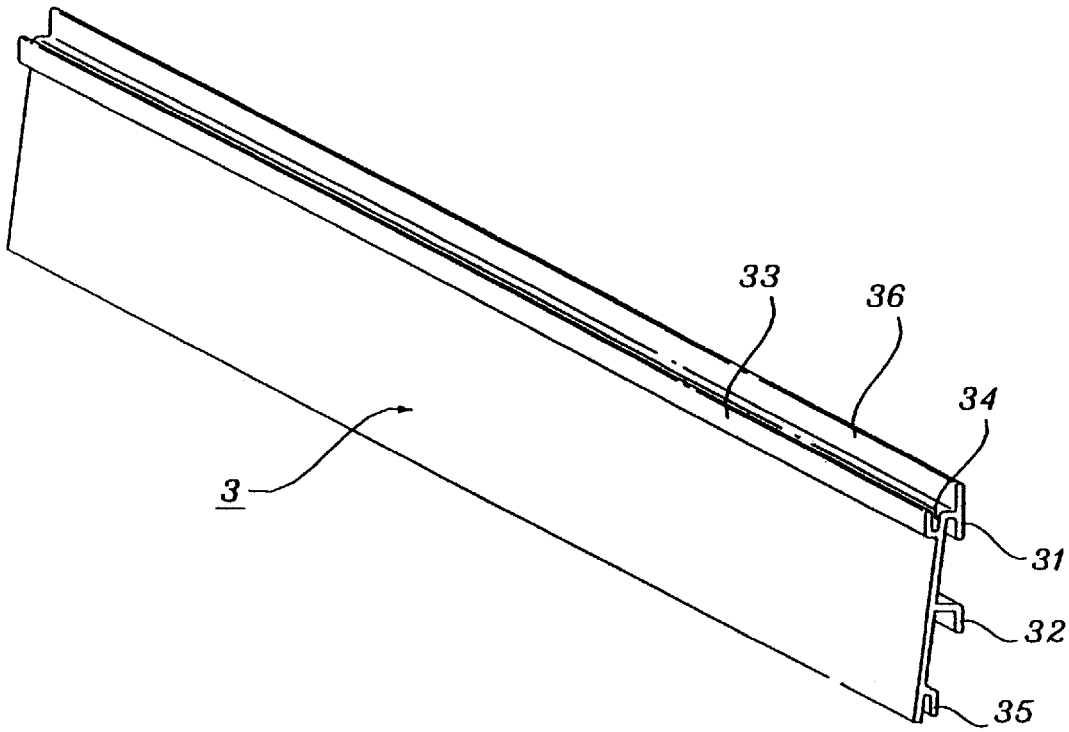
FIG. 3 is a perspective view showing the configuration of a furring panel of this invention.

As shown in FIG. 3, each of the furring panels 3 also has a downward middle insert rail 32 at its middle portion. The middle insert rail 32 horizontally extends on the inside wall of the panel to be parallel to the top insert rail 31. The above middle insert rail 32 is wider than the top insert rail 31. Therefore, when the two rails 31 and 32 are caught by the hooks 23 of the panel holders 2 with each panel 3 passing across the holder 2, the panel 3 forms a slope on the external wall of the building with the top edge of the panel 3 being closer to the building than the bottom edge.

Each of the panels 3 also has an upward guide rail 33 on the outside wall of its top edge. The above guide rail 33 is formed along the top edge of each panel at a position opposite to the top insert rail 31. The above rail 33 forms a top channel 34 in cooperation with the top edge of the panel 3. Each of the panels 3 further has a downward lower rail 35 at its lower edge. The above lower rail 35 is formed along the lower edge of the panel 3.

The panel 3 also has an upward flange 36 extending upwardly from the top insert rail 31. The above flange 36 is selectively used as an area for nails, thus allowing the panel 3 to be selectively fixed to a building using nails.

Figure 4:
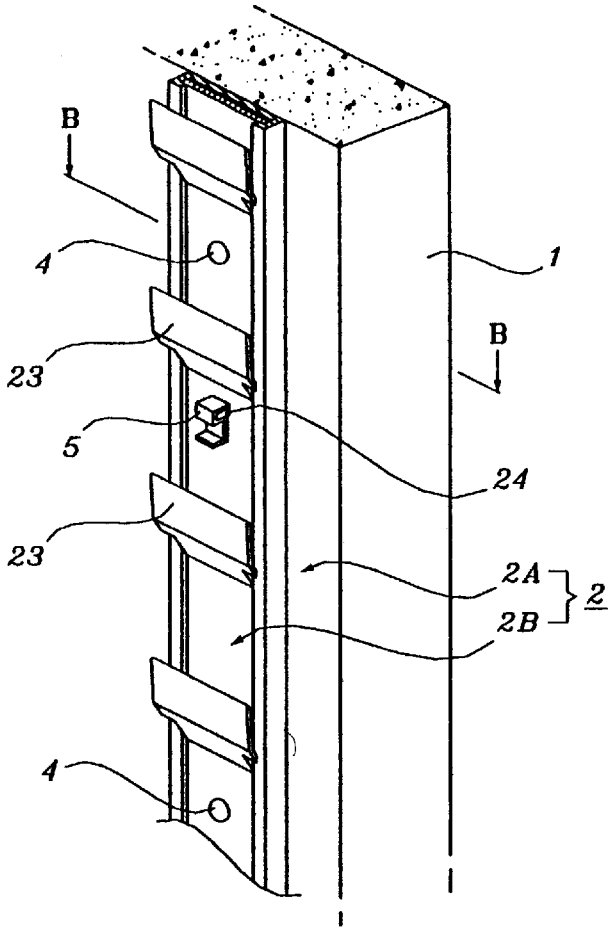
FIG. 4 is a perspective view of a panel holder mounted on the building.
Figure 5:
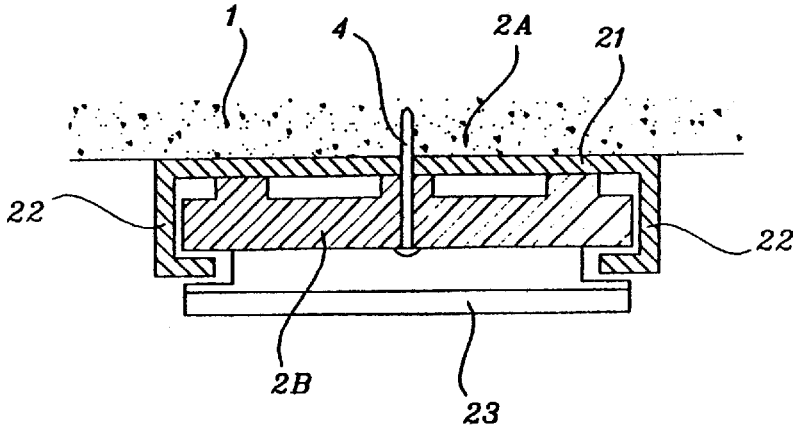
FIG. 5 is a sectional view of the panel holder taken along the line B—B of FIG. 4.
Figure 6:
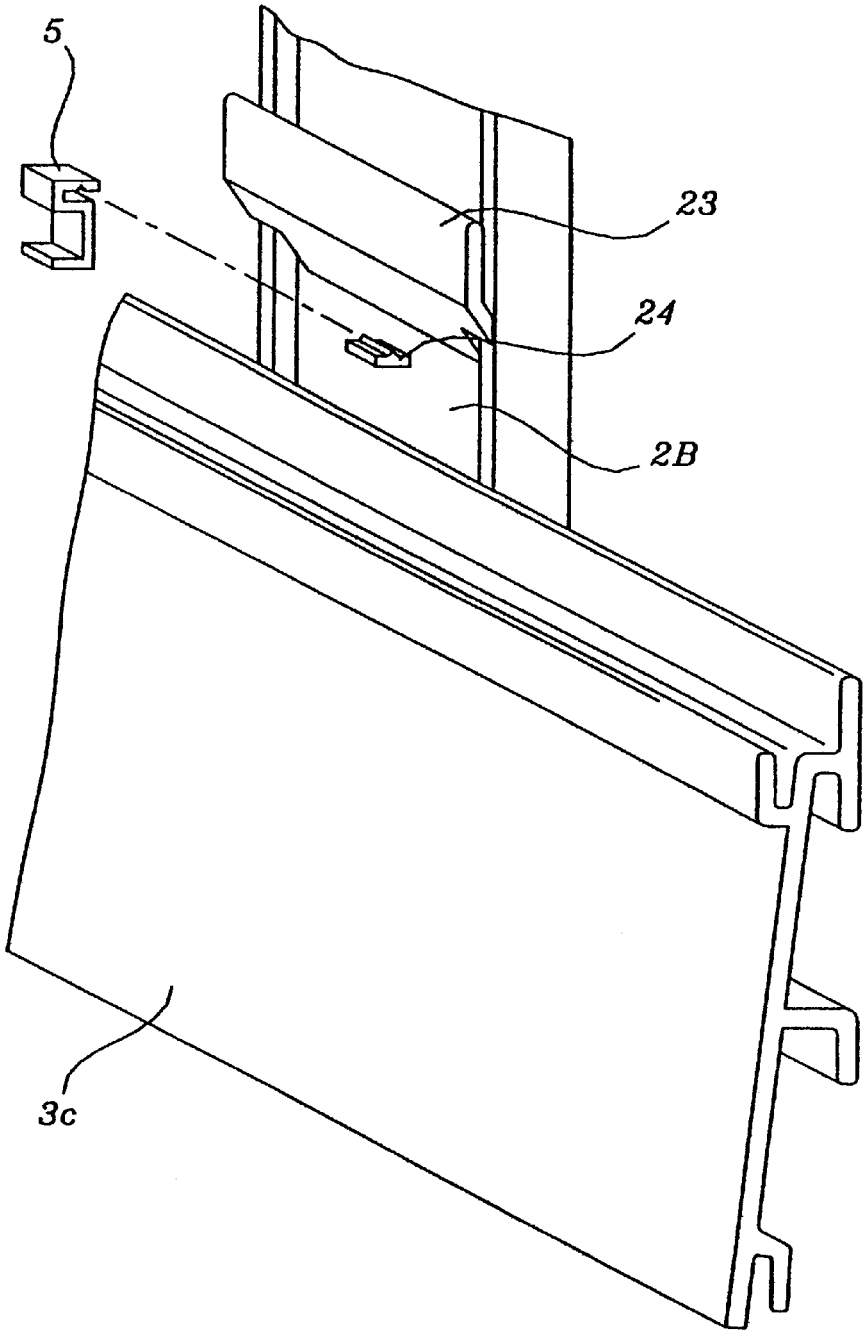
FIG. 6 is a perspective view showing the operational effect of a panel clamp selectively mounted to the panel holder of this invention.

As shown in FIGS. 4 and 5, each of the panel holders 2 comprises a longitudinal frame 2A and a longitudinal support plate 2B. The above frame 2A consists of a longitudinal base wall 21 with one side wall 22 being formed along each side edge of the base wall 21. The above support plate 2B is longitudinally fitted into the frame 2A and holds the hooks 23 thereon. That is, the above hooks 23 are regularly mounted along the support plate 2B.

A plurality of fitting protections 24 are formed along the above support plate 2B at positions between the hooks 23, thus allowing a plurality of panel clamps 5 to be selectively and removably attached on the support plate 2B. Both the frame 2A and the support plate 2B are fixedly mounted to the exterior wall 1 of the building using nails, so that it is possible to prevent the holders 2 from being unexpectedly removed from the building.

The above furring panels 3 are attached on the exterior wall 1 of a building using the structure of this invention as follows.

As shown in FIGS. 1 and 2, the panel holders 2 are vertically and parallel arranged on the exterior wall 1 of a building prior to fixing the holders 2 to the building using locking nails 4. Thereafter, a first furring panel 3*a* is primarily horizontally arranged across the lower portions of the holders 2 with the insert rails 31 and 32 of the panel 3*a* being aligned with the hooks 23 of the holders 2. When the first furring panel 3*a* in the above state is pushed downwardly, the insert rails 31 and 32 are caught by the hooks 23 of the holders 2, so that the first panel 3*a* is held by the holders 2. Thereafter, a second furring panel 3*b* is arranged across the holders 2 at a position above the first panel 3*a* prior to pushing the panel 3*b* downwardly. When the second panel 3*b* is pushed downwardly, the insert rails 31 and 32 of the panel 3*b* are caught by the hooks 23 of the holders 2, while the downward lower rail 35 of the second panel 3*b* is inserted into the top channel 34 of the first panel 3*a*. The two panels 3*a* and 3*b* are thus closely coupled to each other at the junction between them and are movably attached on the exterior wall 1 of the building using the holders 2.

A third furring panel 3*c* is, thereafter, attached to the holders 2 at a position above the second panel 3*b* in the same manner as described for the second panel 3*b*. The above-mentioned process is repeated until a desired area of the building's exterior wall 1 is completely covered with such panels 3.

Sometimes, it may be necessary to temporarily stop the work while attaching the panels 3 on the building using the structure of this invention. In such a case, the furring panels 3, which are already attached to the holders 2, may be unexpectedly removed from the holders 2 due to wind or sudden impact. However, the structure of this invention almost completely overcomes such a problem. That is, when it is necessary to temporarily stop the work after attaching some panels 3, for example, the first to third panels 3*a* to 3*c*, on the wall 1 of the building, at least one clamp 5 is fitted over a fitting protection 24 of the support plate 2B to clamp the top edge of the third panel 3*c*. In such a case, since the top edge of the third panel 3*c* is clamped by the clamp 5, the three panels 3*a* to 3*c* are almost completely prevented from being unexpectedly removed from the holders 2 due to wind or sudden impact.

As described above, the present invention provides a structure for attaching furring panels on the exterior wall of a building. In accordance with the invention, the furring panels are not directly attached on the building, but are indirectly and movably attached on the building using panel holders with hooks of the holders removably catching the insert rails of the panels. Therefore, it is possible to easily attach the panels on the building and prevent the panels from any damage. The structure of this invention also allows the panels to be uniformly expandable or contractible in accordance with a change of atmospheric temperature. Therefore, the above structure almost completely prevents the furring panels from partially warping or cracking, so that the structure improves the rigidity of furring panels and effectively maintains the appearance of a building for a lengthy period of time.

Although the preferred embodiments of the present invention have been disclosed for illustrative purposes, those skilled in the art will appreciate that various modifications, additions and substitutions are possible, without departing from the scope and spirit of the invention as disclosed in the accompanying drawings.

What is claimed is:

1. A structure for attaching furring panels on a building, comprising:

a plurality of longitudinal panel holders for being arranged vertically and parallel on and fixed to an exterior wall of the building, with a plurality of hooks being regularly mounted along each of said holders;

each of said panel holders including a longitudinal frame and a separate support plate longitudinally fitted into said frame with said hooks being regularly mounted along said support plate;

a plurality of furring panels held on said panel holders while passing across said holders;

said panels individually having a plurality of insert rails for being caught by said hooks; and each of said panels having both a top channel formed along its top edge and a downwardly projecting lower rail formed on an inside wall along its lower edge for being coupled to another furring panel with said lower rail being fitted into a top channel of the other furring panel.

2. The structure according to claim 1, wherein each of said panel holders further comprises:

a plurality of fitting projections formed along said support plate at positions between said hooks; and a plurality of panel clamps selectively and removably fitted over said projections to selectively clamp the top edge of a furring panel.

3. The structure according to claim 1, wherein said downward insert rails of each of said panels comprises:

a top insert rail formed along the top edge of each panel to be positioned on an inside wall of each panel; and a middle insert rail horizontally formed on a middle portion of the inside wall of each panel to be parallel to said top insert rail, said middle insert rail being wider than said top insert rail, thus allowing each panel to form a slope when each panel is attached on the building.

4. The structure according to claim 1 wherein said top channel of each of said panels is formed between the top edge of each panel and a guide rail formed along the top edge on an outside wall of each panel.

5. The structure according to claim 1, wherein each of said panels further comprises an upward flange extending upwardly from said top insert rail, said upward flange being selectively used as an area for nails, thus allowing each panel to be selectively fixed to the building using the nails.

6. A structure for attaching furring panels on a building, comprising:

a plurality of longitudinal panel holders for being arranged vertically and parallel on and fixed to an exterior wall of the building, with a plurality of hooks being regularly mounted along each of said holders;

a plurality of furring panels held on said panel holders while passing across said holders;

said panels individually having a plurality of insert rails for being caught by said hooks;

each of said panels having both a top channel formed along its top edge and a downwardly projecting lower rail formed on an inside wall along its lower edge for being coupled to another furring panel with said lower rail being fitted into a top channel of the other furring panel;

each of said panel holders including a plurality of fitting projections formed along said support plate at positions between said hooks; and a plurality of panel clamps selectively and removably fitted over said projections to selectively clamp a top edge of a furring panel.

* * * * *